US009462402B2

(12) United States Patent
Cho et al.

(10) Patent No.: US 9,462,402 B2
(45) Date of Patent: Oct. 4, 2016

(54) MONOLITHIC COMPLEMENTARY METAL-OXIDE SEMICONDUCTOR (CMOS)-INTEGRATED SILICON MICROPHONE

(71) Applicant: Taiwan Semiconductor Manufacturing Co., Ltd., Hsin-Chu (TW)

(72) Inventors: Chin-Yi Cho, Kaohsiung (TW); Chia-Hua Chu, Zhubei (TW); Chun-Wen Cheng, Zhubei (TW); Jung-Huei Peng, Jhubei (TW); Yao-Te Huang, Hsinchu (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 0 days.

(21) Appl. No.: 14/620,368

(22) Filed: Feb. 12, 2015

(65) Prior Publication Data

US 2016/0241979 A1 Aug. 18, 2016

(51) Int. Cl.

| | |
|---|---|
| ***H01R 31/00*** | (2006.01) |
| ***H04R 31/00*** | (2006.01) |
| ***H04R 19/04*** | (2006.01) |

(52) U.S. Cl.

CPC ..... *H04R 31/003* (2013.01); *H04R 19/04* (2013.01); *H04R 2201/003* (2013.01)

(58) Field of Classification Search

CPC ..... H01L 27/0698; H01L 27/14683; H01L 2924/1461; H04R 31/003; H04R 19/04; H04R 2201/003

See application file for complete search history.

(56) References Cited

U.S. PATENT DOCUMENTS

2008/0247573 A1* 10/2008 Pedersen ..... H04R 19/005 381/174
2013/0193527 A1* 8/2013 Chu ..... H01L 21/76898 257/414

OTHER PUBLICATIONS

Scheeper, et al. "A New Measurement Microphone Based on MEMS Technology." IEEE Journal of Microelectromechanical Systems, vol. 12, No. 6, Dec. 2003.
Zou, et al. "A Study on Corrugated Diaphragms for High-Sensitivity Structures." J. Micromech. Microeng. 7 (1997) 310-315.
Kwon, et al. "Double-Chip Condenser Microphone for Rigid Backplate Using DRIE and Wafer Bonding Technology." Sensors and Actuators A 138 (2007) 81-86, May 3, 2007.
Dehe, Alfons. "Silicon Microphone Development and Application." Sensors and Actuators A 133 (2007) 283-287, Jul. 20, 2006.

* cited by examiner

*Primary Examiner* — Nikolay Yushin
(74) *Attorney, Agent, or Firm* — Eschweiler & Associates, LLC

(57) ABSTRACT

Some embodiments relate to a manufacturing process that combines a MEMS capacitor of a microelectromechanical systems (MEMS) microphone and an integrated circuit (IC) onto a single substrate. A dielectric is formed over a device substrate. A conductive diaphragm and a conductive backplate are formed within the dielectric, with a sacrificial portion of the dielectric between them. A first recess is formed, which extends through the dielectric to an upper surface of the conductive diaphragm. A second recess is formed, which extends through the substrate and dielectric to a lower surface of the conductive backplate. The sacrificial layer is removed to create an air gap between the conductive diaphragm and the conductive backplate. The air gap joins the first and second recesses to form a cavity that extends continuously through the dielectric and the substrate. The present disclosure is also directed to the semiconductor structure of the MEMS microphone resulting from the manufacturing process.

20 Claims, 15 Drawing Sheets

MONOLITHIC COMPLEMENTARY METAL-OXIDE SEMICONDUCTOR (CMOS)-INTEGRATED SILICON MICROPHONE

BACKGROUND

Recent developments in the semiconductor integrated circuit (IC) technology include microelectromechanical system (MEMS) devices. MEMS devices include mechanical and electrical features formed by one or more semiconductor manufacturing processes. Examples of MEMS devices include micro-sensors, which convert mechanical signals into electrical signals; micro-actuators, which convert electrical signals into mechanical signals; and motion sensors, which are commonly found in automobiles (e.g., in airbag deployment systems). For many applications, MEMS devices are electrically connected to integrated circuits (ICs) to form complete MEMS systems.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
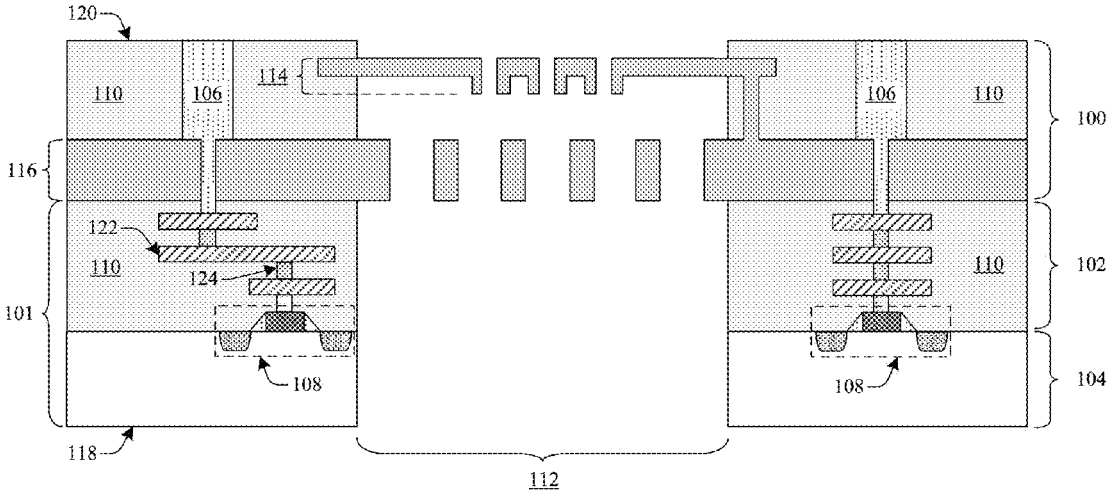
FIG. 1 illustrates a cross-sectional view of some embodiments of a microelectromechanical systems (MEMS) microphone connected and an integrated circuit (IC) by through-silicon-vias (TSVs).

The present disclosure provides many different embodiments, or examples, for implementing different features of this disclosure. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s)

as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Moreover, "first", "second", "third", etc. may be used herein for ease of description to distinguish between different elements of a figure or a series of figures. "First", "second", "third", etc. are not intended to be descriptive of the corresponding element. Therefore, "a first substratelectric layer" described in connection with a first figure may not necessarily corresponding to a "first substratelectric layer" described in connection with another figure.

A microelectromechanical systems (MEMS) microphone often includes a MEMS capacitor arranged within a cavity of a first substrate, which is connected to an integrated circuit (IC) arranged on a second, separate substrate. The MEMS capacitor includes a conductive diaphragm and a conductive backplate. During operation of the MEMS microphone, the conductive diaphragm oscillates relative to the conductive backplate in response to sound wave to produce a time-varying capacitance. The IC measures the time-varying capacitance and produces a corresponding electrical signal.

The first and second substrates are often laterally arranged next to each other on a printed circuit board (PCB) that is within a package. The first and second substrates are bonded to one another by one or more bonding wires. The one or more bonding wires provide for relatively long electrical connections between the first and second substrates, which can result in parasitic capacitance, inductance, and/or resistance that negatively impact acoustics of the MEMS microphone. This is because slight variations in the packaging process can lead to large variations in performance of the MEMS microphone. In addition, because the MEMS capacitor and the IC are formed on separate substrates, the packaging process adds additional complexity and cost over the formation of the MEMS capacitor or the IC alone.

Therefore, the present disclosure is directed to a manufacturing process that combines a MEMS microphone and an IC onto a single substrate. A dielectric is formed over a substrate. A conductive diaphragm and a conductive backplate are formed within the dielectric, with a sacrificial portion of the dielectric arranged between them. A first recess is formed, which extends through the dielectric to an upper surface of the conductive diaphragm. A second recess is formed, which extends through the substrate and dielectric to a lower surface of the conductive backplate. The sacrificial portion is removed to create an air gap between the conductive diaphragm and the conductive backplate. The air gap joins the first and second recesses to form a cavity that extends continuously through the dielectric and the substrate. Advantages of this manufacturing process for a MEMS microphone include simplicity, manufacturability, and cost efficiency, over a conventional manufacturing process that uses an additional packaging step. This manufacturing process also improves performance, enhances acoustic quality, and reduces process variability over other manufacturing process. The present disclosure is also directed to the semiconductor structure of the MEMS microphone resulting from the manufacturing process.

FIG. 1 shows a cross-sectional view of some embodiments of a MEMS microphone 100 arranged over an integrated circuit (IC) 101, so that the IC 101 and the microphone 100 share a substrate 104. The IC 101 comprises the substrate 104 and an overlying BEOL metal stack 102 having one or more metal layers, 122 and 124. The IC 101 includes at least one semiconductor device 108 (e.g., a complementary metal-oxide semiconductor (CMOS) transistor). The MEMS microphone 100 includes a conductive diaphragm 114 (e.g., polysilicon) arranged in a cavity 112 at a first position above the substrate 104, and a conductive backplate 116 (e.g., polysilicon) arranged in the cavity 112 at a second position between the conductive diaphragm 114 and the substrate 104. The cavity 112 extends from a lower surface 118 of the substrate 104 to an upper surface 120 of the dielectric 110. The MEMS microphone 100 and the IC 101 are electrically connected by through-silicon-vias (TSVs) 106.

The TSVs 106 electrically connect the MEMS microphone 100 to the IC 101 through at least one metal wire layer 122 and at least one metal via 124 arranged within the dielectric 110. The electrical connection between the MEMS microphone 100 and the IC 101 by the TSVs 106 reduces manufacturing complexity, cost, and variability, while improving performance of the MEMS microphone 100.

Figure 2:
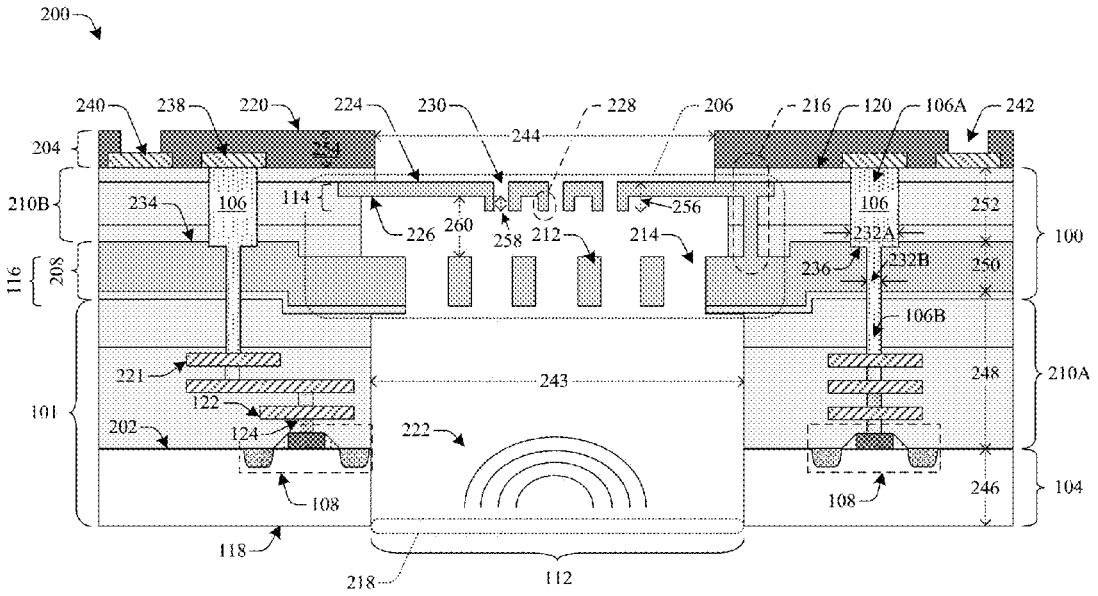
FIG. 2 illustrates a cross-sectional view of some embodiments of a MEMS microphone connected and an IC by TSVs.

FIG. 2 illustrates a cross-sectional view of some embodiments of a MEMS device 200 having a microphone 100 arranged over and electrically connected to an IC 101 by TSVs 106. The IC 101 includes at least one semiconductor device 108 arranged within a substrate 104 and a first plurality of dielectric layers 210A located over an upper surface 202 of the substrate 104. A conductive layer 208 (e.g., polysilicon) is arranged over the first plurality of dielectric layers 210A. A second plurality of dielectric layers 210B are arranged over the conductive layer 208. A passivation layer 204 (e.g., silicon nitride (SiN)) is optionally arranged over the second plurality of dielectric layers 210B. A cavity 112 extends from a lower surface 118 of the substrate 104, through the first and second pluralities of dielectric layers 210A, 210B and the conductive layer 208, to an upper surface 220 of the passivation layer 204.

The MEMS microphone 100 includes a MEMS capacitor 206. The MEMS capacitor 206 includes a conductive diaphragm 114 (e.g., polysilicon) arranged over the upper surface 202 of the substrate 104, and a conductive backplate 116 arranged within the one or more dielectric layers 210 between the conductive diaphragm 114 and the substrate 104. The conductive backplate 116 is disposed within a portion of the conductive layer 208. The conductive backplate 116 is partitioned into segments 212 under the conductive diaphragm 114. Spaces 214 between the segments 212 allow for the passage of sound waves through the cavity 112 between the conductive diaphragm 114 and the lower surface 118 of the substrate 104. The conductive diaphragm 114 is coupled to the conductive layer 208 by a vertical column 216 of conductive material (e.g., polysilicon).

During microphone operation, sound in the form of a time-varying pressure wave 222 strikes the conductive diaphragm 114, thereby causing small displacements in the conductive diaphragm 114 relative to the conductive backplate 116. Depending on a package configuration, the time-varying pressure wave 222 may strike the conductive diaphragm 114 from different sides. For example, in some embodiments, the time-varying pressure wave 222 may pass through an aperture 218 within the lower surface 118 of the substrate 104, and through the cavity 112, as shown in FIG. 2. Alternatively, the time-varying pressure wave 222 may approach the conductive diaphragm 114 from an opposite direction (i.e., from the "top" side of the conductive diaphragm 114).

The magnitude and frequency of the displacements correspond to a volume and pitch of the time-varying pressure wave 222. To convert these displacements into an electrical signal, the IC 101 measures the time-varying capacitance between the conductive diaphragm 114 and the conductive backplate 116. For example, the IC 101 can supply a predetermined charge to the conductive diaphragm 114 in time (e.g., a predetermined current through the metallization layers 122, the vias 124, the TSVs 106, and the vertical column 216 of conductive material, to the conductive diaphragm 114). The IC 101 can then monitor voltage changes between the conductive diaphragm 114 and the conductive backplate 116 as a function of the charge. By taking regular current and voltage measurements, the IC 101 can track the capacitance according to the voltage/current relationship:

$$I(t) = C\frac{dV(t)}{dt}$$

where C is the capacitance. Because the time-varying capacitance reflects the time-varying distance between the conductive diaphragm 114 and conductive backplate 116 (and thus distance changes in time based on the time-varying pressure wave 222), the IC 101 can thereby provide an electrical signal representative of the time-varying pressure wave 222 on the conductive diaphragm 114.

An upper surface 224 of the conductive diaphragm 114 is substantially planar. A lower surface 226 of the conductive diaphragm 114 includes at least two anti-stiction bumps 228, which protrude from the lower surface 226. The anti-stiction bumps 228 mitigate against adhesion between the conductive diaphragm 114 and the conductive backplate 116. Holes 230 extend through the conductive diaphragm 114 between two anti-stiction bumps 228.

The TSVs 106 extend from the passivation layer 204 to a top metallization layer 221 within the IC 101. The TSVs 106 include a first portion 106A of a first width 232A, which extends from the upper surface 120 the second plurality of dielectric layers 210B to a position 236 beneath an upper surface 234 of the conductive layer 208. In some embodiments, the first portion 106A terminates at the upper surface 234 of the conductive layer 208, rather than the position 236 beneath an upper surface 234. The TSVs 106 also include a second portion 106B of a second width 232B, where the second width is 232B is less than the first width 232A. The second portion 106B of the TSVs 106 extends from the top metallization layer 221 of the IC 101 to a position 236 beneath the upper surface 234 of the conductive layer 208. In some embodiments, the second portion 106B terminates at the upper surface 234 of the conductive layer 208. The first and second portions 106A, 106B of the TSVs 106 form tapered TSV structures, which electrically connect the MEMS microphone 100 to the IC 101.

Contact pads 238 of metal material are arranged over, and in contact with, the TSVs 106. Input/output (I/O) pads 240 of the metal material are arranged under recessed regions 242 of the passivation layer 204. The contact pads 238 and the I/O pads 240 are connected to one another through a redistribution layer of conductive material arranged over an upper surface 120 of the second plurality of dielectric layers 210B. In some embodiments, the I/O pads 240 form an external connection to packaging through either wire-bonding or flip chip process, depending on design needs and the packaging type. The I/O pads 240 deliver power and signal to the MEMS microphone 100 and the IC 101. In some embodiments, the conductive material includes aluminum (Al), copper (Cu), AlCu, or another suitable metal material.

Acoustical performance of the MEMS microphone 100 depends upon the size and shape of the cavity 112. The cavity 112 has a first width 243 at the lower surface 118 of the substrate 104, and a second width 244 at the upper surface 220 of the passivation layer 204. The first width 243 is greater than or equal to the second width 244. In some embodiments, the first width 243 is in a range of about 500 to about 2,000 microns (μm). In some embodiments, the second width 244 is in a range of about 500 to about 1,500 μm. A height of the cavity 112 is dependent upon thicknesses of the various layers of the MEMS microphone 100 and the IC 101. In some embodiments, the substrate 104 has a thickness 246 in a range of about 250 μm to about 500 μm. In some embodiments, the first plurality of dielectric layers 210A have a thickness 248 in a range of about 5 μm to about 15 μm. In some embodiments, conductive layer 208 has a thickness 250 in a range of about 3 μm to about 10 μm. In some embodiments, the second plurality of dielectric layers 210B have a thickness 252 in a range of about 3 μm to about 10 μm. In some embodiments, passivation layer 204 has a thickness 254 in a range of about 1 μm to about 2 μm. In some embodiments, conductive diaphragm has a thickness 256 in a range of about 0.5 μm to about 3 μm. In some embodiments, the anti-stiction bumps have a height 258 in a range of about 1 μm to about 5 μm. In some embodiments, the conductive diaphragm 114 and the backplate 116 are separated by an air gap 260 in a range of about 2 μm to about 8 μm. The air gap 260 is formed by removing a sacrificial portion of one or more dielectric layers, which are arranged between the conductive diaphragm 114 and the backplate 116, during manufacture of the MEMS device 200.

Figure 3:
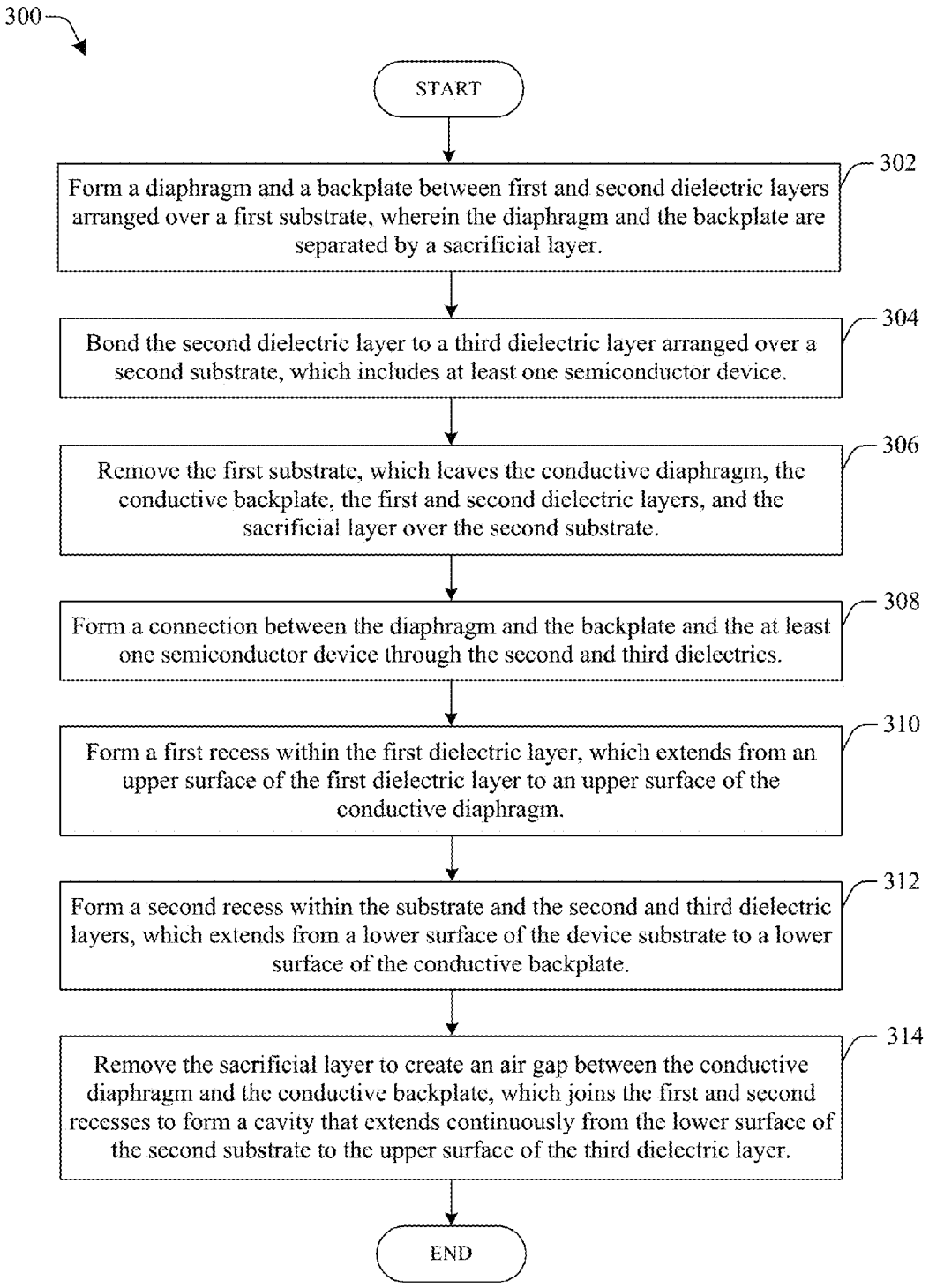
FIG. 3 illustrates a flow chart of some embodiments of a method for manufacturing a MEMS microphone connected and an IC by TSVs.

FIG. 3 illustrates a flow chart of some embodiments of a method 300 for manufacturing a MEMS microphone connected and an IC by TSVs. While method 300 is described as a series of acts or events, it will be appreciated that the illustrated ordering of such acts or events are not to be interpreted in a limiting sense. For example, some acts may occur in different orders and/or concurrently with other acts or events apart from those illustrated and/or described herein. In addition, not all illustrated acts may be required to implement one or more aspects or embodiments of the description herein. Further, one or more of the acts depicted herein may be carried out in one or more separate acts and/or phases.

At 302, a diaphragm and a backplate are formed between first and second dielectric layers arranged over a first substrate. A sacrificial layer of dielectric and conductive material separates the conductive diaphragm from a conductive backplate.

At 304, the second dielectric layer is bonded to a third dielectric layer arranged over a second substrate, which includes at least one semiconductor device. In some embodiments, the second and third dielectric layers the second and third dielectric layers include oxide layers (e.g., $SiO_2$) that are bonded by a fusion bonding process. During the fusion bonding process, the second and third dielectric layers are heated and pressed against one another to form a fusion bond. In other embodiments, other dielectric materials and bonding mechanisms are used.

At 306, the first substrate is removed by a chemical-mechanical polish (CMP) or other appropriate process. The removal of the first substrate leaves the conductive diaphragm, the conductive backplate, the first and second dielectric layers, and the sacrificial portion over the second substrate.

At 308, a connection is formed between the diaphragm and the backplate and the at least one semiconductor device through the second and third dielectrics. In some embodiments, the connection is formed by a TSV.

At 310, a first recess is formed within the first dielectric layer. The first recess extends from an upper surface of the first dielectric layer to an upper surface of the conductive diaphragm.

At 312, a second recess is formed within the substrate and the second and third dielectric layers. The second recess extends from a lower surface of the second substrate to a lower surface of the conductive backplate.

At 314, the sacrificial portion is removed to create an air gap between the conductive diaphragm and the conductive backplate. The air gap joins the first and second recesses to form a cavity that extends continuously from the lower surface of the second substrate to the upper surface of the first dielectric layer. The conductive diaphragm and the conductive backplate are consequently arranged within the cavity.

FIGS. 4-32 illustrate a series of cross-sectional views of some embodiments of a MEMS microphone, which is connected and an IC by TSVs, at various stages of manufacture. Although FIGS. 4-32 are described in relation to the method 300, it will be appreciated that the structures disclosed in FIGS. 4-32 are not limited to the method 300, but instead may stand alone as structures independent of the method 300. Similarly, although the method 300 is described in relation to FIGS. 4-32, it will be appreciated that the method 300 is not limited to the structures disclosed in FIGS. 4-32, but instead may stand alone independent of the structures disclosed in FIGS. 4-32.

FIGS. 4-18 illustrate cross-sectional views corresponding to act 302 of the method 300.

Figure 4:
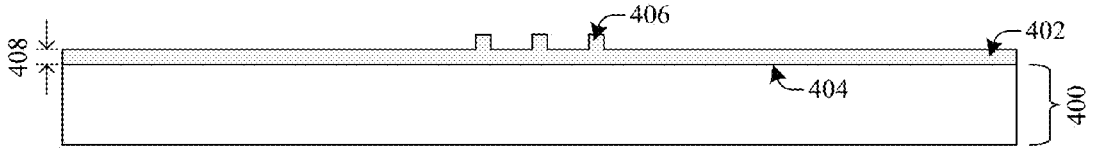
FIGS. 4-32 illustrate a series of cross-sectional views of some embodiments of a MEMS microphone, which is connected and an IC by TSVs, at various stages of manufacture.

As shown in FIG. 4, a first substrate 400 has provided. A first dielectric layer 402 (e.g., silicon dioxide ($SiO_2$)) has been disposed on an upper surface 404 of the first substrate 400 by an oxidation process (e.g., wet oxidation), layer deposition process (e.g., chemical vapor deposition (CVD)), or other appropriate process(es). The first dielectric layer 402 has then been patterned and etched by a photolithography process to form bumps 406, which are used to form anti-stiction bumps in a subsequent manufacturing act.

A geometry of the bumps 406 is determined by specific design needs of the MEMS microphone. For example, in some embodiments, the geometry of the bumps 406 is determined by the resulting acoustical properties of the bumps 406. In some embodiments, the first dielectric layer 402 has a thickness 408 in a range of about 2 μm to about 3 μm.

Figure 5:
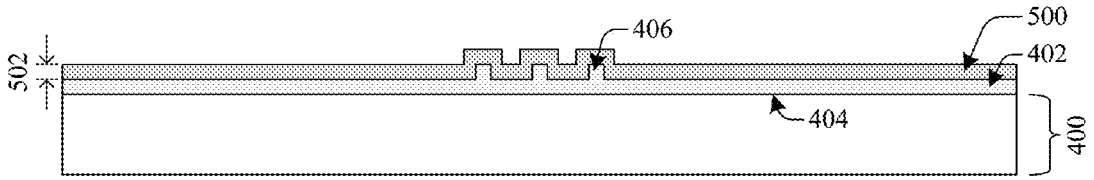

As shown in FIG. 5, a first conductive layer 500 (e.g., polysilicon) has been disposed over the first dielectric layer 402. In some embodiments, the first conductive layer 500 is disposed by CVD (e.g., low-pressure CVD (LPCVD) or plasma-enhanced CVD (PECVD)), physical vapor deposition (PVD), atomic layer deposition (ALD), molecular beam epitaxy (MBE), electron beam (e-beam) epitaxy, or other appropriate layer deposition process. The first conductive layer 500 conformally overlays the bumps 406 of the first dielectric layer 402. In some embodiments, the first conductive layer 500 has a thickness 502 in a range of about 1 μm to about 2 μm.

Figure 6:
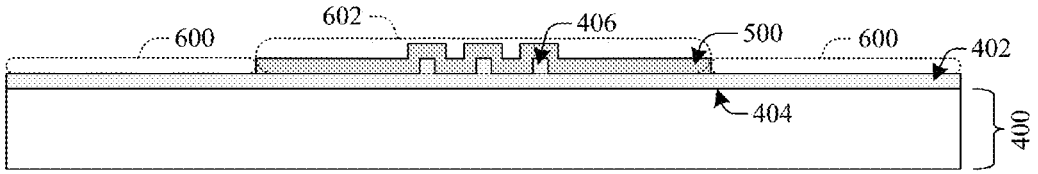

As shown in FIG. 6, the first conductive layer 500 has been optionally patterned and etched by a photolithography process to remove first portions 600 of the first conductive layer 500 that do not overlay the bumps 406, which leaves a second portion 602 overlaying the bumps 406. In some embodiments, the first conductive layer 500 has been optionally patterned and etched at act 302 of the method 300. In other embodiments, the first portions 600 of the first conductive layer 500 can be removed at a later stage of manufacture.

Figure 7:
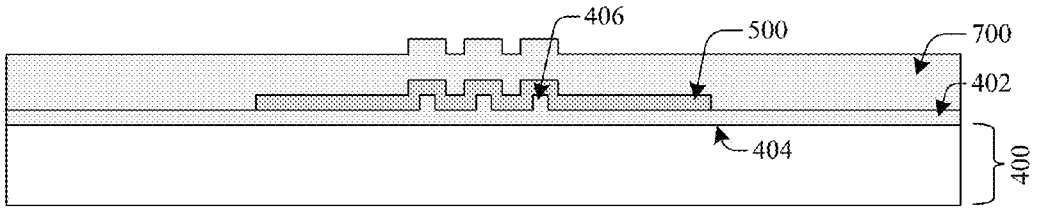

As shown in FIG. 7, a first sacrificial dielectric layer 700 (e.g., oxide) has been disposed over the patterned first conductive layer 500 and the first dielectric layer 402 by CVD or other appropriate deposition process. The first sacrificial dielectric layer 700 conformally overlays the patterned first conductive layer 500.

Figure 8:
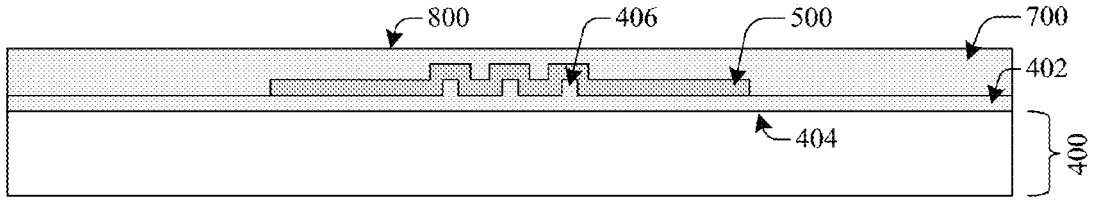

As shown in FIG. 8, an upper surface 802 of the conformal first sacrificial dielectric layer 700 has been planarized by a CMP, or other planarization process, to remove surface topography caused by the underlying bumps 406. The surface topography could also be dealt with at a later stage of manufacture, or ignored depending on specific design needs.

Figure 9:
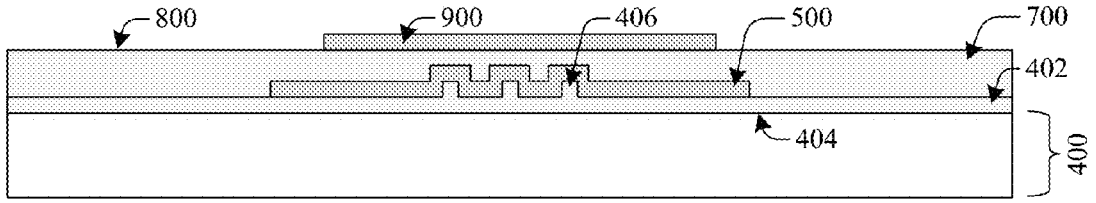

As shown in FIG. 9, a sacrificial conductive layer 900 (e.g., polysilicon) has been disposed over the planarized first sacrificial dielectric layer 700. The sacrificial conductive layer 900 has subsequently been patterned and etched, by a photolithography process, to remove portions that do not overlay the remaining the patterned first conductive layer 500.

Figure 10:
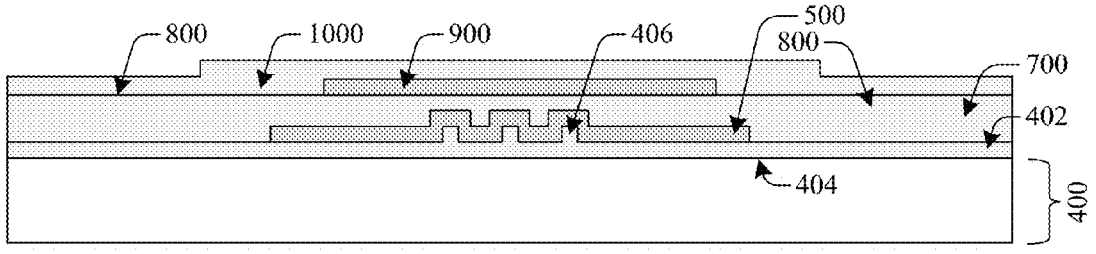

As shown in FIG. 10, a second sacrificial dielectric layer 1000 (e.g., oxide) has been disposed over the patterned sacrificial conductive layer 900 and the planarized first sacrificial dielectric layer 700, by CVD or other appropriate deposition process. The second sacrificial dielectric layer 1000 conformally overlays the patterned sacrificial conductive layer 900. The first and second sacrificial dielectric layers 700, 1000 and the sacrificial conductive layer 900 collectively form a substantial portion of the sacrificial layer of the act 302 of the method 300.

Figure 11:
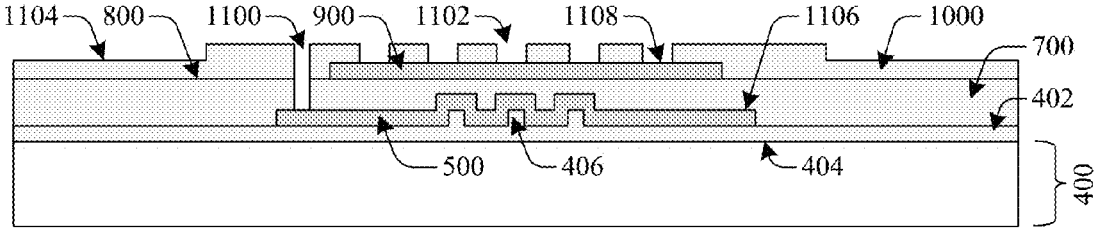

As shown in FIG. 11, the first and second sacrificial dielectric layers 700, 1000 have been patterned and etched by one or more photolithography process(es) to form a first trench 1100. The first trench 1100 extends from an upper surface 1104 of the conformal second sacrificial dielectric layer 1000 to an upper surface 1106 of the first conductive layer 500. The first trench 1100 provides an opening for a signal wiring path to the first conductive layer 500. The one or more photolithography process(es) also form a plurality of second trenches 1102, which extend from the upper surface 1104 of the second sacrificial dielectric layer 1000 to an upper surface 1108 of the sacrificial conductive layer 900. In some embodiments, the first and second trenches 1100, 1102 may be formed by a single patterning act. During the single patterning act, a layer of photoresist is formed over the upper surface 1104 of the conformal second sacrificial dielectric layer 1000, exposed to a mask pattern, and developed to transfer the mask pattern into the layer of photoresist. The first and second trenches 1100, 1102 are then etched simultaneously through the layer of photoresist, and into the second sacrificial dielectric layer 1000, with an etchant. In some embodiments, the etchant is a wet or dry etchant that etches the first and second trenches 1100, 1102 isotropically. In some embodiments, the etchant has a selectivity between dielectric material of the first and second sacrificial dielectric layers 700, 1000, and conductive material of the first conductive layer 500 and the sacrificial conductive layer 900. The selectivity allows the etchant to etch the first and second sacrificial dielectric layers 700, 1000, while leaving the first conductive layer 500 and the sacrificial conductive layer 900 substantially intact.

Figure 12:
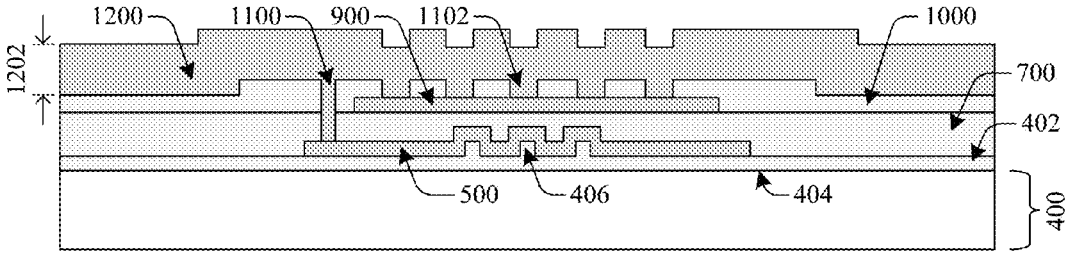

As shown in FIG. 12, a second conductive layer 1200 is disposed over the patterned second sacrificial dielectric layer 1000 by CVD or other appropriate deposition process. The second conductive layer 1200 conformally overlays the patterned second sacrificial dielectric layer 1000. Conductive material (e.g., polysilicon) of the second conductive layer 1200 fills the first and second trenches 1100, 1102. In some embodiments, the second conductive layer 1200 has a thickness 1202 in a range of about 5 μm to about 10 μm.

Figure 13:
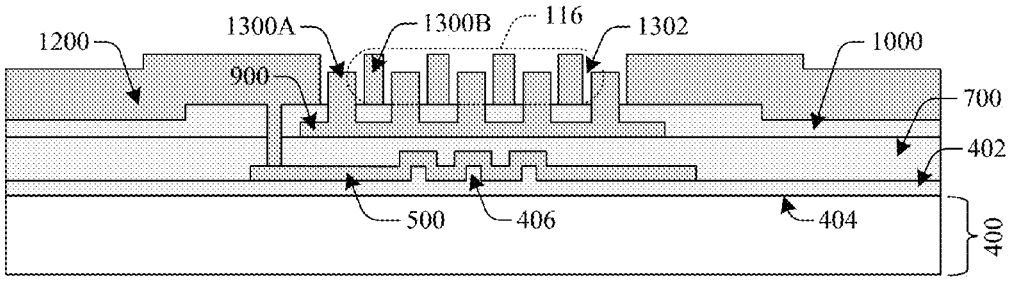

As shown in FIG. 13, the conformal second conductive layer 1200 has been patterned and etched, through a photolithography process, to form first and second vertical segments 1300A, 1300B, which are separated by gaps 1302. The first vertical segments 1300A and the sacrificial conductive layer 900 both include a same conductive material (e.g., polysilicon), and are in direct contact with one another. Consequently, the first vertical segments 1300A form vertical portions of the sacrificial conductive layer 900. The second vertical segments 1300B form a backplate 116 of a MEMS microphone. The second vertical segments 1300B of the backplate 116 are patterned to be connected with the second conductive layer 1200 and to be laterally interleaved with the vertical segments (1300A) of the sacrificial conductive layer 900 (i.e., to be laterally separated from the first vertical segments 1300A) along the illustrated cross-section.

Figure 14:
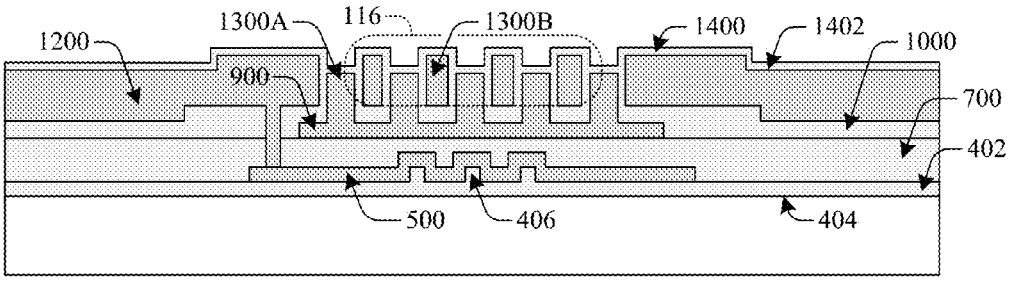

As shown in FIG. 14, a trench liner dielectric 1400 has been formed over exposed surfaces of the first and second vertical segments 1300A, 1300B, and over an upper surface 1402 of the second conductive layer 1200. In some embodiments, the trench liner dielectric 1400 has been formed by a wet or dry oxidation, CVD, or other appropriate layer growth or deposition process. The trench liner dielectric 1400 and the second sacrificial dielectric layer 1000 both include a same dielectric material (e.g., $SiO_2$), and are in direct contact with one another. Consequently, the trench liner dielectric 1400 forms a portion of the second sacrificial dielectric layer 1000. The resultant second sacrificial dielectric layer 1000 surrounds the second vertical segments 1300B of the backplate 116. The second sacrificial dielectric layer 1000 extends between the second vertical segments 1300B of the backplate 116 and the first vertical segments 1300A of the sacrificial conductive layer 900.

Figure 15:
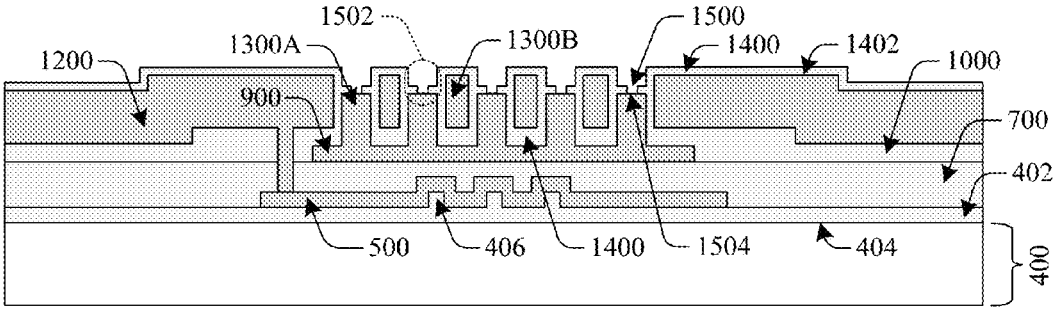

As shown in FIG. 15, holes 1500 have been etched through portions of the second sacrificial dielectric layer 1000 formed by the trench liner dielectric 1400 by a photolithography process. The holes 1500 are consequently arranged within trenches 1502. The holes 1500 expose upper surfaces 1504 of the vertical segments (1300A) of the sacrificial conductive layer 900.

Figure 16:
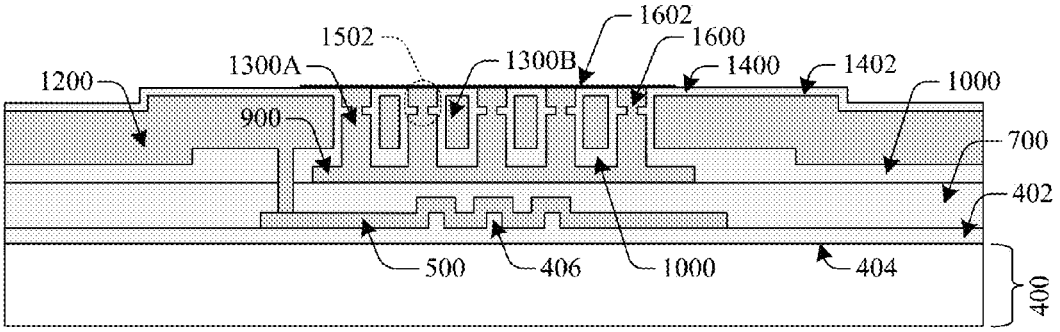

As shown in FIG. 16, the holes 1500 and trenches 1502 have been filled with a conductive material 1600 (e.g., polysilicon). In some embodiments, the conductive material 1600 and the sacrificial conductive layer 900 both include a same conductive material, and are in direct contact with one another. Consequently, the conductive material 1600 forms a portion of the sacrificial conductive layer 900. The resulting structure is then planarized by an etch or CMP process to form continuous planar surface 1602, which includes exposed portions of the sacrificial conductive layer 900 (i.e., the conductive material 1600) and exposed portions of the second sacrificial dielectric layer 1000 (i.e., the trench liner dielectric 1400).

Figure 17:
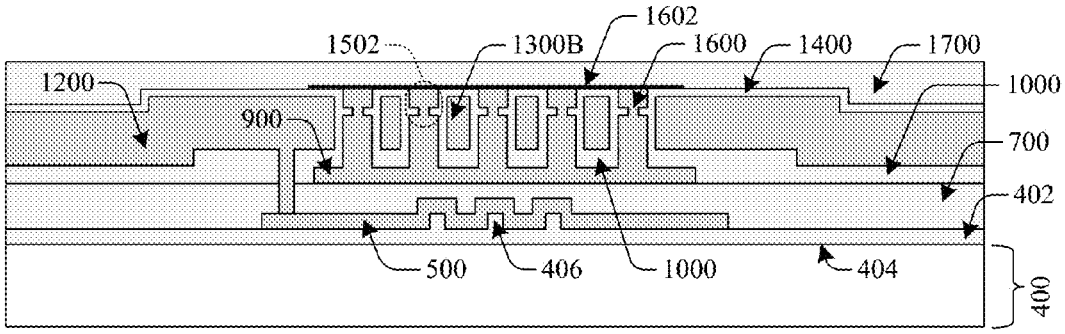

As shown in FIG. 17, a second dielectric layer 1700 has been formed over the continuous planar surface 1602 by CVD or other appropriate deposition process, and planarized by an appropriate process.

Figure 18:
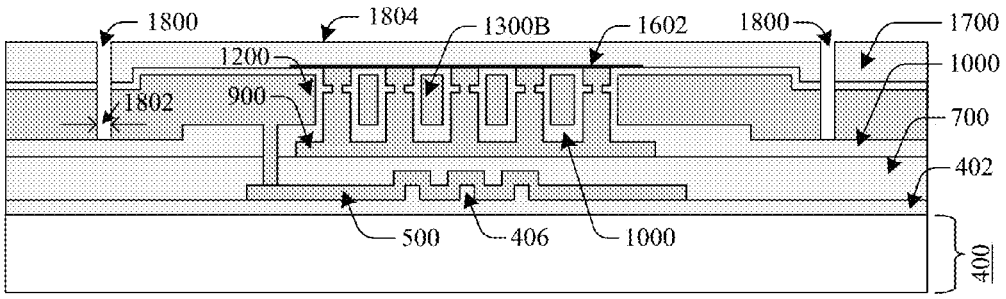

As shown in FIG. 18, first trenches 1800 of a first width 1802 have etched from an upper surface 1804 of the second dielectric layer 1700 to an upper surface of the first sacrificial dielectric layer 700 by a photolithography process.

Figure 19:
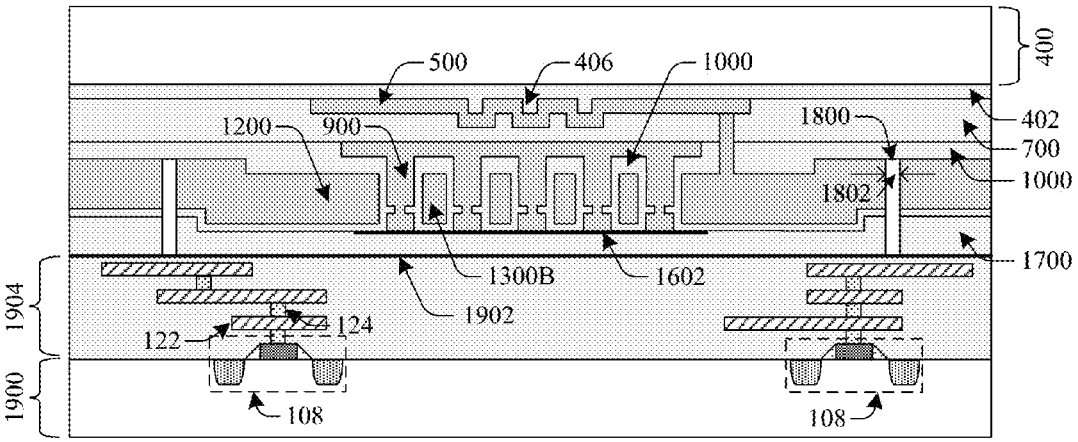

FIG. 19 illustrates a cross-sectional view corresponding to act 304 of the method 300. As shown in FIG. 19, the first substrate has been flipped over and bonded to a second substrate 1900. In some embodiments, the second substrate 1900 includes at least one semiconductor device 108, such as a metal-oxide semiconductor field-effect transistor (MOSFET), or other semiconductor device. The semiconductor device 108 is connected to metallization layers 122 and vias 124, which are arranged within the third dielectric layer 1904.

The bonding of the first and second substrates is achieved by forming a fusion bond 1902 between the second dielectric layer 1700 and a third dielectric layer 1904 arranged over the second substrate 1900. In some embodiments, the second and third dielectric layers 1700, 1904 includes oxides. In some embodiments, the third dielectric layer 1904 includes an oxide arranged over one or more inter-metal dielectric (IMD) and/or inter-layer dielectric (ILD) layers, where the metallization layers 122 and the vias 124 are arranged within the one or more IMD and/or ILD layers.

Figure 20:
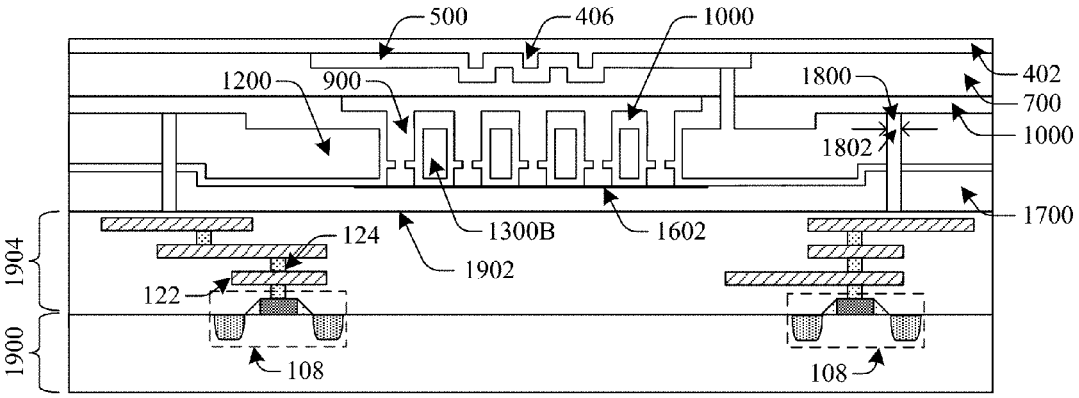

In FIG. 20, which corresponds to act 306 of the method 300, the first substrate 400 has been removed by a CMP or other appropriate substrate removal process.

Upon removal of the first substrate 400, if the first conductive layer 500 was not optionally patterned and etched in FIG. 6, it may be patterned and etched at this stage of manufacture to remove the first portions 600 that do not overlay the bumps 406, which leaves the second portions 602 overlaying the bumps 406. This may be achieved by removing the first dielectric layer 402 (e.g., through an etch), patterning the first conductive layer 500 in a manner similar to that shown in FIG. 6, and replacing the first conductive layer 500 with a comparable conductive layer.

FIGS. 21-24 illustrate cross-sectional views corresponding to act 306 of the method 300.

Figure 21:
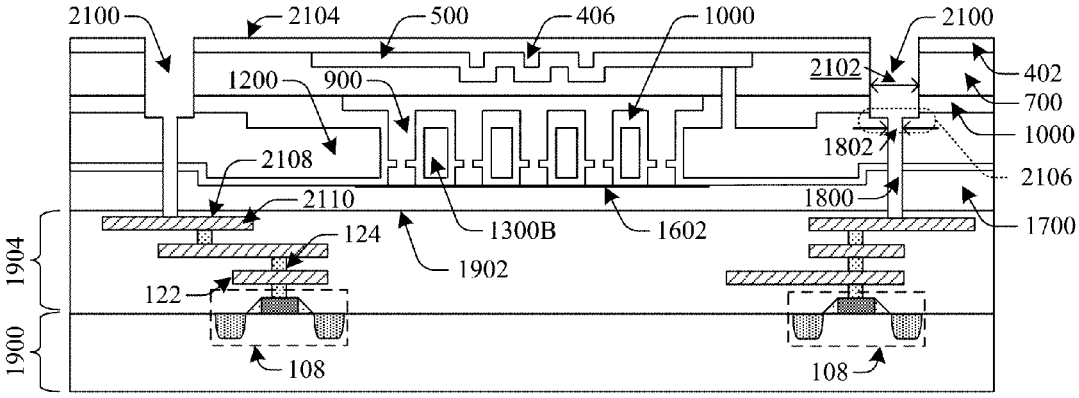

As shown in FIG. 21, second trenches 2100 of a second width 2102 have been formed through a pattern and etch process, where the second width 2102 is greater than the first width 1802. The second trenches 2100 extend from a top surface 2104 of the first dielectric layer 402, and into the second conductive layer 1200, where they meet the first trenches 1800 near an interface 2106 to the second conductive layer 1200. The etch also extends the first trenches through the fusion bond 1902, and into the third dielectric layer 1904, where they terminate at a top surface 2108 of a top metal layer 2110. The first and second trenches 1800, 2100 combine to form openings for paths for power and signal delivery to the semiconductor device 108 from an external stimulus.

Figure 22:
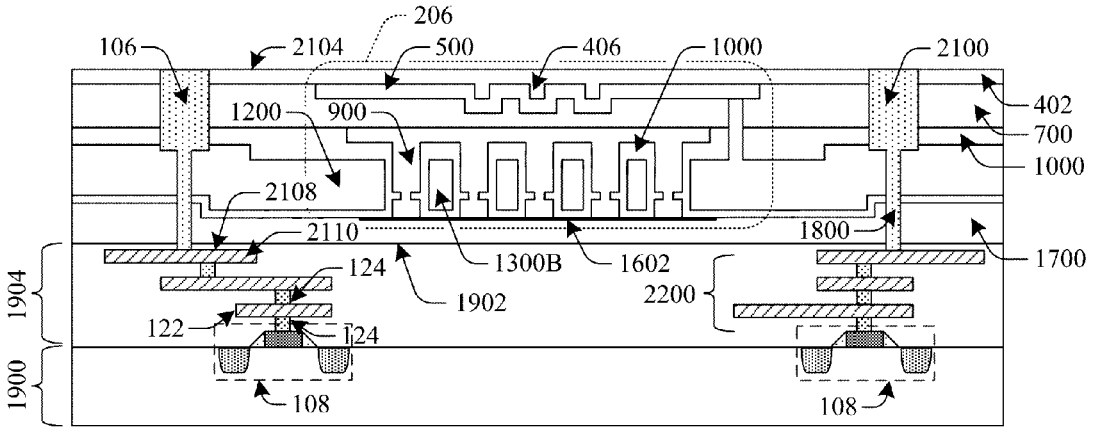

As shown in FIG. 22, the first and second trenches 1800, 2100 are filled with a metal material to form TSVs 106, which extend from the top surface 2104 of the first dielectric layer 402 to the top surface 2108 of a top metal layer 2110. In some embodiments, the metal material includes tungsten (W). The TSVs 106 form an electrical connection between the (unfinished) MEMS capacitor 206 and the semiconductor device 108, through a back-end-of-the-line (BEOL) stack 2200, which includes the metallization layers 122 and the vias 124 disposed within the third dielectric layer 1904. By forming a connection between the MEMS capacitor 206 and the semiconductor device 108 using one or more TSVs 106, a parasitic capacitance between the MEMS capacitor 206 and the semiconductor device 108 is reduced over fabrication processes that use wire-bonding to connect a MEMS capacitor and a semiconductor device formed on separate substrates.

Figure 23:
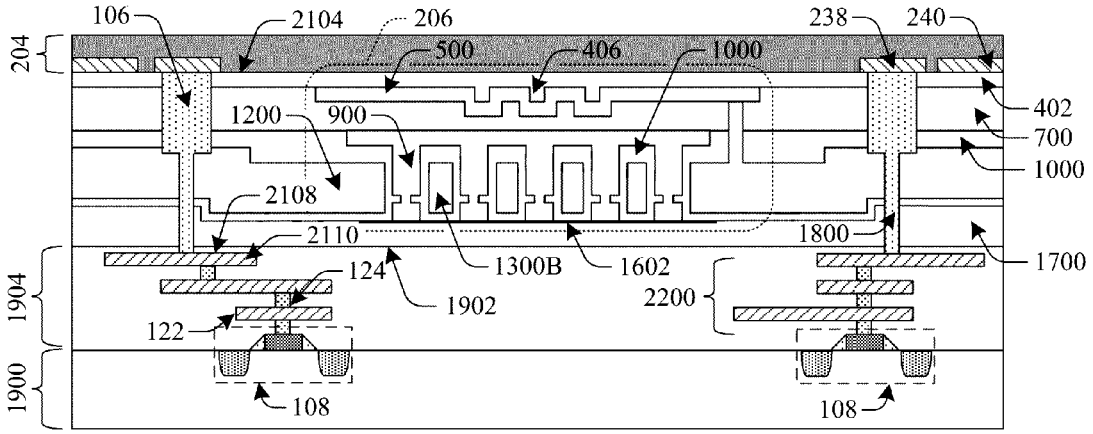

As shown in FIG. 23, a layer of metal material (e.g., AlCu) has been deposited over the top surface 2104 of the first dielectric layer 402 through CVD, sputtering, or other appropriate deposition technique, and patterned and etched to form contact pads 238 and I/O pads 240. The contact pads 238 are arranged over, and in contact with, the TSVs 106. The contact pads 238 and the I/O pads 240 connect to one another through a redistribution layer (not shown) formed from the layer of metal material. In some embodiments, a passivation layer 204 (e.g., SiN) is optionally disposed over the first dielectric layer 402 by LPCVD or other appropriate deposition technique. The passivation layer 204 is configured to act as an insulator and chemical diffusion barrier.

Figure 24:
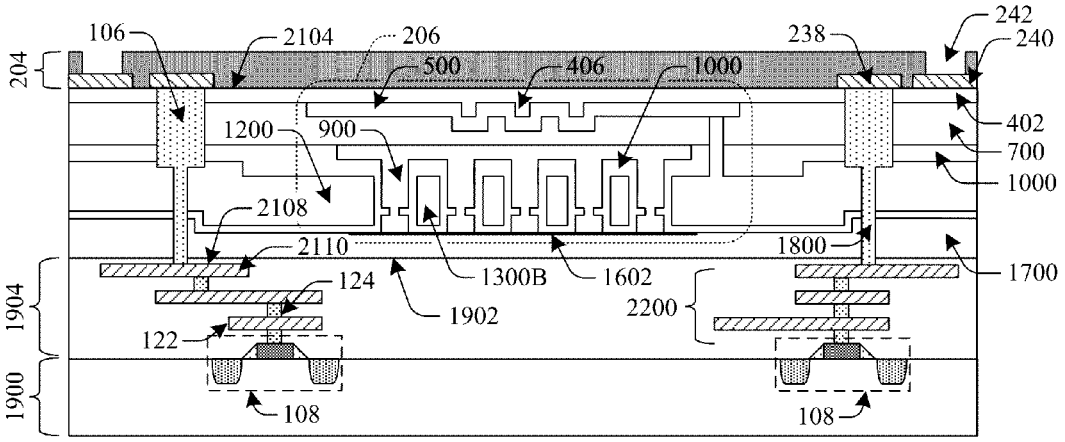

As shown in FIG. 24, the passivation layer 204 has been patterned and etched to form recessed regions 242 over the I/O pads 240, which expose the I/O pads 240 for external connections. In some embodiments, the I/O pads 240 form an external connection to packaging through either wire-bonding or flip chip process, depending on design needs and the packaging type.

Figure 25:
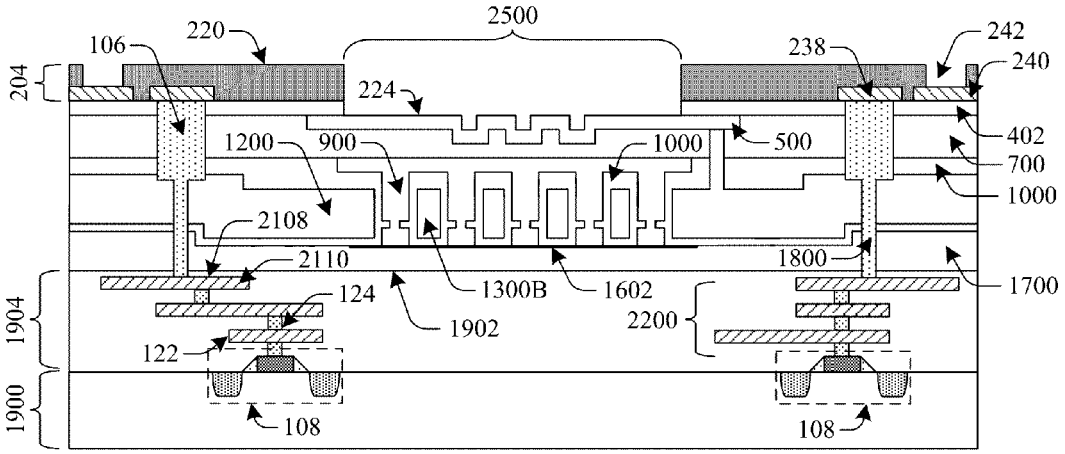
Figure 26:
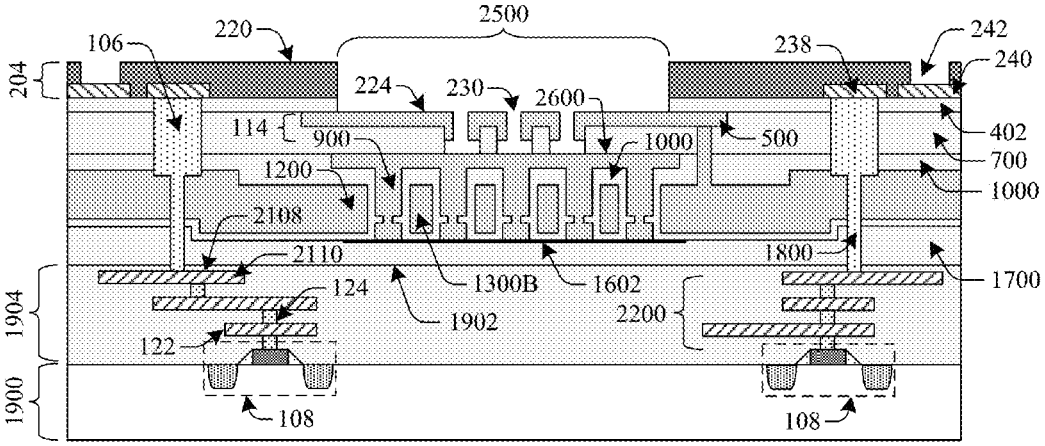
Figure 27:
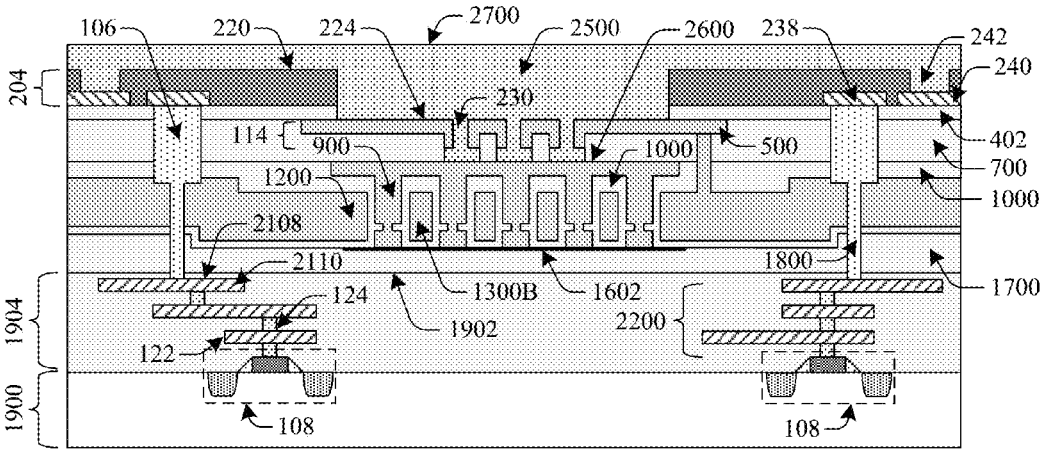

FIGS. 25-27 illustrate cross-sectional views corresponding to act 310 of the method 300.

As shown in FIG. 25, a first recess 2500 has been formed within the passivation layer 204 and the first dielectric layer 402. In some embodiments, the first recess 2500 has been formed by a three-step etch process: a two-stage dry etch is used to remove the passivation layer 204 from over the first dielectric layer 402, followed by a wet etch of the first dielectric layer 402. In some embodiments, the wet etch utilizes a first selective etchant with a first etch selectivity between dielectric material (e.g., $SiO_2$) of the first dielectric layer 402 and conducting material (e.g., polysilicon) of the first conducting layer 500, such that it etches the first dielectric layer 402 away while leaving the first conducting layer 500 substantially intact. The resulting first recess 2500 extends from an upper surface 220 of the passivation layer 204 to an upper surface 224 of the first dielectric layer 402.

As shown in FIG. 26, the first recess 2500 has been extended below the first conductive layer 500 through a two-step pattern and etch process, which includes a dry etch that forms holes 230 though the first conductive layer 500, and completes formation of a diaphragm 114. The two-step etch process also includes a wet etch that extends the first recess 2500 through the holes 230 and into the first sacrificial dielectric layer 700. The extended portions of the first recess 2500 terminate at an upper surface 2600 of the sacrificial conductive layer 900.

As shown in FIG. 27, a first masking layer 2700 has been formed within the first recess 2500 and along the upper surface 220 of the passivation layer 204. The first masking layer 2700 is configured to provide protection during subsequent etching steps. In some embodiments, the first masking layer 2700 includes photoresist, polyimide, or other appropriate material. In some embodiments, the first masking layer 2500 has been disposed by a spin coating technique, by a spray coating technique, or by a sputtering technique.

Figure 28:
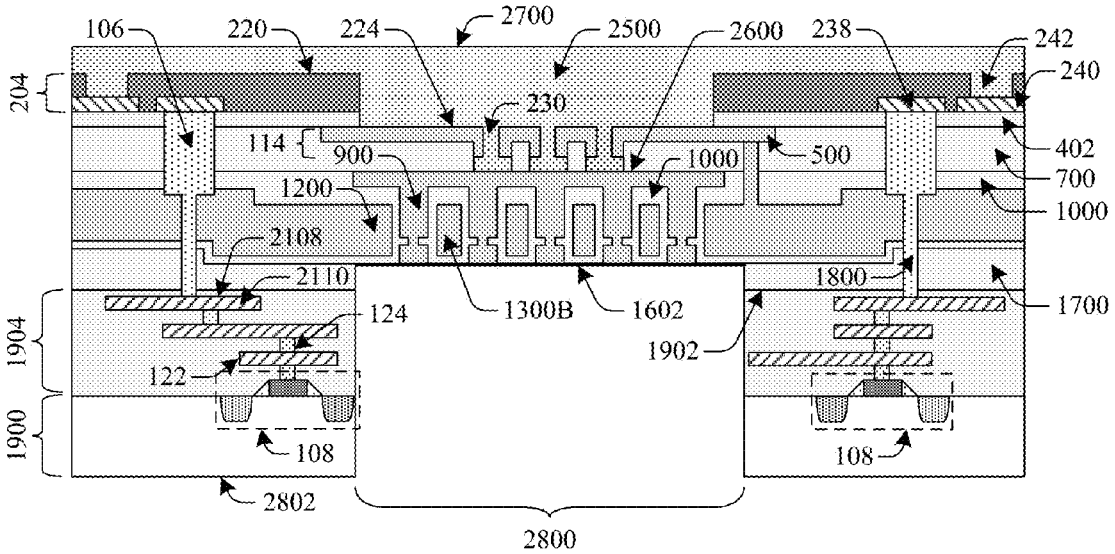
Figure 29:
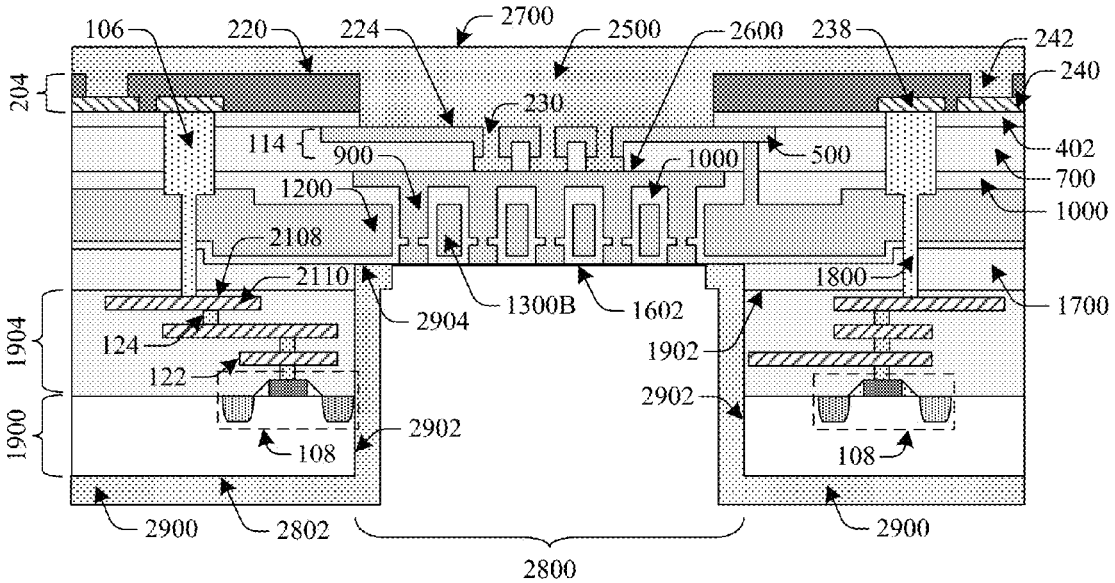

FIGS. 28-29 illustrate cross-sectional views corresponding to act 312 of the method 300.

As shown in FIG. 28, a second recess 2800 has been formed within the second substrate 1900, and the second and third dielectric layers 1700, 1904. The second recess 2800 extends from a lower surface 2802 of the second substrate 1900 to the continuous planar surface 1602, which includes exposed portions of the sacrificial conductive layer 900 and exposed portions of the second sacrificial dielectric layer 1000. In some embodiments, the second recess has been formed by a process which includes: thinning of the second substrate 1900 by grinding, followed by a deep etching process (e.g., a reactive ion etch (RIE)) through the lower surface 2802 of the second substrate 1900, and a controlled dry etch with an etch rate calibrated to terminate the second recess 2800 at or near the continuous planar surface 1602.

As shown in FIG. 29, a second masking layer 2900 has been disposed along sidewalls 2902 of the second recess 2800 and along the horizontal regions 2904 of the second sacrificial dielectric layer 1000 at the top of the second recess 2800, while leaving an opening over the continuous planar surface 1602. The second masking layer 2900 is configured to provide protection during subsequent etching steps, to allow etching of the continuous planar surface 1602 through the opening. In some embodiments, the second masking layer 2900 includes photoresist, polyimide, germanium (Ge), or other appropriate material. In some embodiments, the second masking layer 2900 has been disposed by a spray coating technique, or by a sputtering technique.

Figure 30:
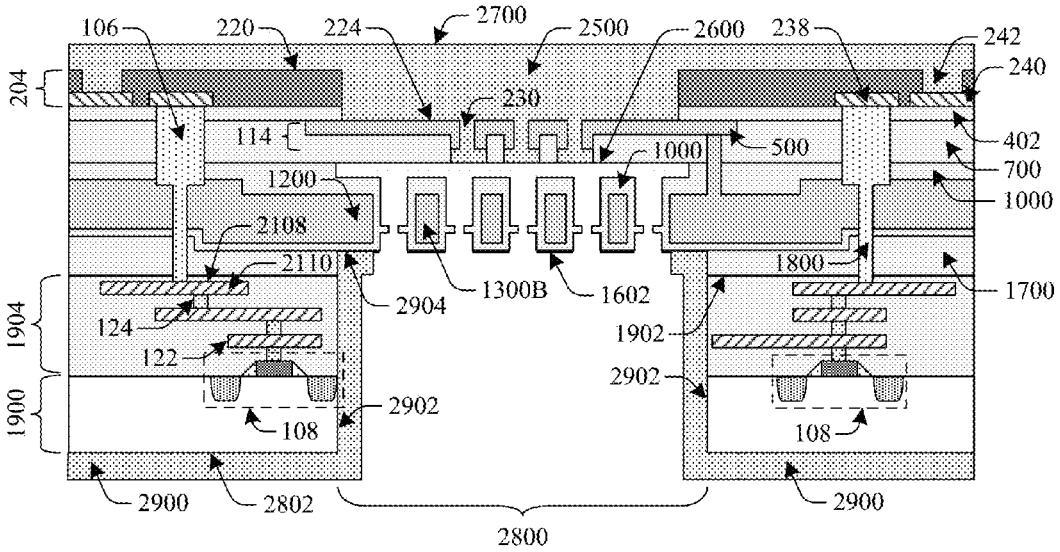
Figure 31:
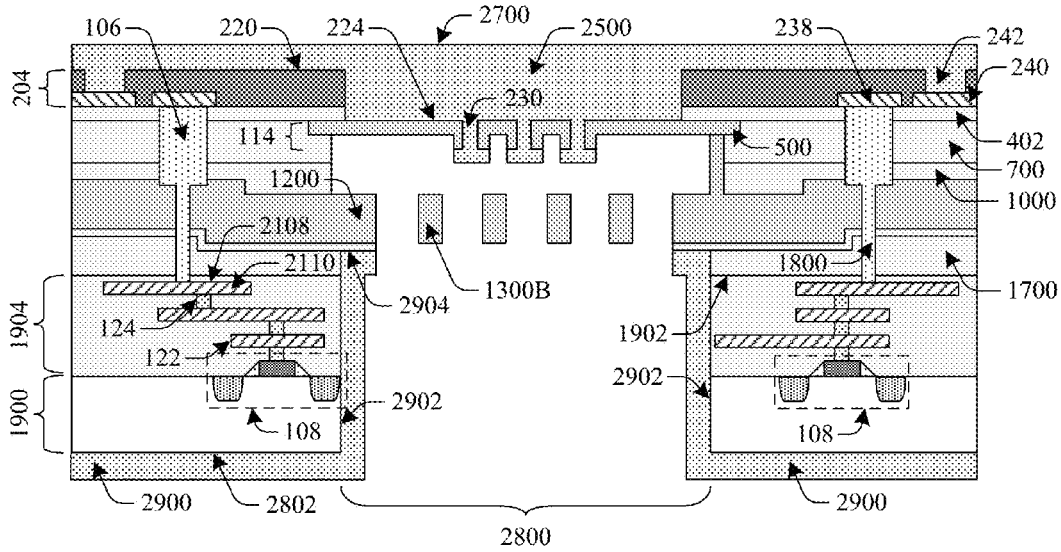
Figure 32:
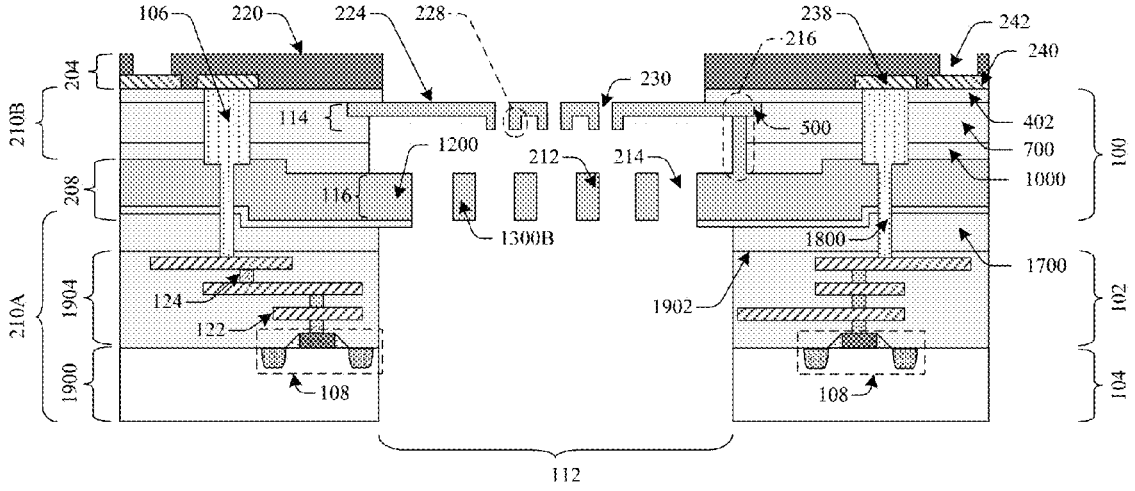

FIGS. 30-32 illustrate cross-sectional views corresponding to act 314 of the method 300.

As shown in FIG. 30, a first etch is performed to the continuous planar surface 1602, which is also an upper surface of the second recess 2800. The first etch is performed with a first etchant that has a first selectivity between conductive material (e.g., polysilicon) of the sacrificial conductive layer 900 and dielectric material (e.g., oxide) of the second sacrificial dielectric layer 700, such that it etches the sacrificial conductive layer 900 away, while leaving the second sacrificial dielectric layer 700 substantially intact. In some embodiments, the first etchant may have an etching chemistry comprising sulfur hexafluoride (SF6) or xenon difluoride (XeF2), for example.

As shown in FIG. 31, a second etch is performed with a second etchant, which has a second selectivity between the conductive material of the second conductive layer 1200 and the second sacrificial dielectric layer 700, which is opposite of the first selectivity. Consequently, the second etchant etches the second sacrificial dielectric layer 1000 while leaving the second vertical segments 1300B to form a backplate 116 and the diaphragm 114 substantially intact. In some embodiments, the second etchant may comprise a liquid phase of hydroflouric acid (HF), for example.

As shown in FIG. 32, the first and second masking layers 2700, 2900 have been removed by an ash, etch, or other appropriate process(es), which results in the MEMS microphone 100 and the IC 101 of FIG. 2, which are arranged over the same substrate 104 (the second substrate 1900), and electrically connected by the TSVs 106.

Therefore, the present disclosure is directed to a manufacturing process that combines a MEMS microphone and an IC onto a single substrate.

Some embodiments relate to a method, comprising forming a conductive diaphragm and a conductive backplate within one or more dielectric layers arranged over a substrate, which includes at least one semiconductor device. The method further comprises forming a first recess within the one or more dielectric layers, which extends from an upper surface of the one or more dielectric layers to an upper surface of the conductive diaphragm. The method also comprises forming a second recess within the substrate and the one or more dielectric layers, which extends from a lower surface of the substrate to a lower surface of the conductive backplate. The method also comprises removing a sacrificial portion of the one or more dielectric layers between the conductive diaphragm and the conductive backplate to join the first and second recesses and to form a cavity that extends continuously from the lower surface of the substrate to the upper surface of the one or more dielectric layers.

Other embodiments relate to a method, comprising forming a diaphragm and a backplate between first and second dielectric layers arranged over a first substrate. The first dielectric layer if formed between the diaphragm and the first substrate. The backplate is formed between the diaphragm and the second dielectric layer. The diaphragm and the backplate are separated by a sacrificial layer. The method further comprises bonding the second dielectric layer to a third dielectric layer disposed over a second substrate, which includes at least one semiconductor device. The method further comprises removing the first substrate. The method further comprises forming a first recess extending from an upper surface of the first dielectric layer to an upper surface of the diaphragm. The method further comprises forming a second recess extending from a lower surface of the second substrate to a lower surface of the backplate. The method further comprises removing the sacrificial layer to create an air gap between the diaphragm and the backplate. The air gap joins the first and second recesses to form a cavity extending continuously from the lower surface of the second substrate to the upper surface of the third dielectric layer.

Still other embodiments relate to a sensor, comprising a substrate including at least one semiconductor device, with one or more dielectric layers arranged over an upper surface of the substrate. A cavity extends from a lower surface of the substrate to an upper surface of the one or more dielectric layers. A MEMS capacitor, comprising a conductive diaphragm arranged over the upper surface of the substrate and a conductive backplate, is arranged within the one or more dielectric layers between the conductive diaphragm and the substrate.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method, comprising:

forming a conductive diaphragm and a conductive backplate within one or more dielectric layers arranged over a substrate, which includes at least one semiconductor device;

forming a first recess within the one or more dielectric layers, which extends from an upper surface of the one or more dielectric layers to an upper surface of the conductive diaphragm;

forming a second recess within the substrate and the one or more dielectric layers, which extends from a lower surface of the substrate to a lower surface of the conductive backplate; and removing a sacrificial portion of the one or more dielectric layers between the conductive diaphragm and the conductive backplate to join the first and second recesses and to form a cavity that extends continuously from the lower surface of the substrate to the upper surface of the one or more dielectric layers.

2. The method of claim 1, further comprising connecting the conductive diaphragm and the conductive backplate to the at least one semiconductor device by a through-silicon-via (TSV), which has a first width in a region above the conductive backplate, and a second width below the conductive backplate, wherein the second width is less than the first width.

3. The method of claim 1, further comprising:

forming holes though the conductive diaphragm;

extending the first recess through the holes and into the sacrificial portion between the conductive diaphragm and the conductive backplate; and forming a first masking layer within the first recess and along the upper surface of the one or more dielectric layers.

4. The method of claim 3, further comprising forming a second masking layer along sidewalls of the second recess and along the lower surface of the substrate, while leaving an opening over a lower surface of the conductive backplate.

5. The method of claim 4, wherein the conductive backplate is partitioned into segments, which are interleaved with the sacrificial portion of the one or more dielectric layers.

6. The method of claim 4, wherein removing the sacrificial portion of the one or more dielectric layers comprises exposing the sacrificial portion of the one or more dielectric layers to an etchant, through the opening of the second masking layer, having a selectivity between the conductive diaphragm, the conductive backplate, and the sacrificial portion of the one or more dielectric layers, such that the etchant removes the sacrificial portion of the one or more dielectric layers while leaving the conductive diaphragm and the conductive backplate substantially intact.

7. The method of claim 6, wherein horizontal regions of a top of the second recess near the sidewalls of the second recess are covered by the second masking layer.

8. A method, comprising:

forming a diaphragm and a backplate between first and second dielectric layers arranged over a first substrate, wherein the first dielectric layer is formed between the diaphragm and the first substrate, wherein the backplate is formed between the diaphragm and the second dielectric layer, and wherein the diaphragm and the backplate are separated by a sacrificial layer;

bonding the second dielectric layer to a third dielectric layer disposed over a second substrate, which includes at least one semiconductor device;

removing the first substrate;

forming a first recess extending from an upper surface of the first dielectric layer to an upper surface of the diaphragm;

forming a second recess extending from a lower surface of the second substrate to a lower surface of the backplate; and removing the sacrificial layer to create an air gap between the diaphragm and the backplate, which joins the first and second recesses to form a cavity extending continuously from the lower surface of the second substrate to the upper surface of the first dielectric layer.

9. The method of claim 8, wherein the second and third dielectric layers comprise oxide, which are bonded by a fusion bonding process comprising heating and pressing the second and third dielectric layers together.

10. The method of claim 9, wherein forming the sacrificial layer comprises:

forming a first sacrificial dielectric layer over the diaphragm;

forming a sacrificial conductive layer over the first sacrificial dielectric layer;

patterning and etching the sacrificial conductive layer to remove portions not over the diaphragm; and forming a second sacrificial dielectric layer over the sacrificial conductive layer and the first sacrificial dielectric layer.

11. The method of claim 10, further comprising forming the backplate on a conductive layer, which is disposed between the first and second dielectric layers, wherein the conductive layer is partitioned into segments under the diaphragm.

12. The method of claim 11, further comprising:

interleaving the segments of the backplate with vertical portions of the sacrificial conductive layer along a cross-section; and surrounding the segments of the backplate with the second sacrificial dielectric layer, which extends between the segments and the vertical portions of the sacrificial conductive layer, wherein the second sacrificial dielectric layer and exposed surfaces of the vertical portions of the sacrificial conductive layer form an upper surface of the second recess.

13. The method of claim 12, wherein removing the sacrificial layer comprises:

performing a first etch to the upper surface of the second recess with a first etchant that has a first selectivity between the sacrificial conductive layer and the second sacrificial dielectric layer, such that it etches the sacrificial conductive layer while leaving the second sacrificial dielectric layer substantially intact; and performing a second etch to the upper surface with a second etchant that has a second selectivity between the sacrificial conductive layer and the first and second sacrificial dielectric layers, which is opposite of the first selectivity, such that it etches the first and second sacrificial dielectric layers while leaving the backplate and diaphragm substantially intact.

14. The method of claim 13, prior to bonding the first and second substrates, forming a first trench of a first width, which extends from the second dielectric layer to an upper surface of the conductive layer; and after bonding the first and second substrates and removing the first substrate, forming a second trench of a second width, which extends from an upper surface of the first dielectric layer, and which meets the first trench at an interface between the first dielectric layer and the conductive layer, wherein the first width is less than the second width.

15. The method of claim 14, further comprising filling the first and second trenches with conductive material to form a through-silicon-via (TSV), which electrically couples the diaphragm and the backplate to the semiconductor device.

16. A sensor, comprising:

a substrate including at least one semiconductor device;

one or more dielectric layers arranged over an upper surface of the substrate;

a cavity, which continuously extends from a lower surface of the substrate through an upper surface of the one or more dielectric layers facing away from the substrate; and a microelectromechanical system (MEMS) capacitor, comprising a conductive diaphragm arranged over the upper surface of the substrate, and a conductive backplate, which is arranged within the one or more dielectric layers between the conductive diaphragm and the substrate.

17. The sensor of claim 16, wherein an upper surface of the conductive diaphragm is substantially planar; and wherein a lower surface of the conductive diaphragm includes at least two anti-stiction bumps, which protrude from the lower surface; and wherein a hole extends through the conductive diaphragm between the at least two anti-stiction bumps.

18. The sensor of claim 16, further comprising:

a through-silicon-via (TSV), which extends from the upper surface of the one or more dielectric layers, and which electrically couples the MEMS capacitor to the semiconductor device;

wherein the TSV includes a first portion of a first width, which extends from the upper surface of the one or more dielectric layers to an upper surface of a conductive layer upon which the conductive backplate is formed; and wherein the TSV includes a second portion of a second width, which extends from a metallization layer disposed in the one or more dielectric layers to the upper surface of a conductive layer.

19. The sensor of claim 16, wherein the cavity has a first width at the lower surface of the substrate;

wherein the cavity has a second width at the upper surface of the one or more dielectric layers; and wherein the first width is greater than or equal to the second width.

20. The sensor of claim 16, wherein the conductive backplate protrudes outward from a sidewall of the one or more dielectric layers to over the cavity.

* * * * *